United States Patent [19]

Bender

[11] Patent Number: 4,502,255

[45] Date of Patent: Mar. 5, 1985

[54] APPARATUS FOR HOLDING WORKPIECES

[75] Inventor: Albert Bender, Ostfildern, Fed. Rep. of Germany

[73] Assignee: Maschinenfabrik Gehring Gesellschaft mit beschränkter Haftung & Co. Kommanditgesellschaft, Ostfildern, Fed. Rep. of Germany

[21] Appl. No.: 390,675

[22] Filed: Jun. 21, 1982

[30] Foreign Application Priority Data

Jun. 26, 1981 [DE] Fed. Rep. of Germany ..... 3125188

[51] Int. Cl.[3] ..... B24B 19/00

[52] U.S. Cl. ..... 51/227 R; 269/74; 269/305; 51/216 R; 51/34 R

[58] Field of Search ..... 51/216 R, 227 R, 281 P, 51/290, 238 GG, 34 R; 269/74, 76, 81, 303, 304, 305

[56] References Cited

U.S. PATENT DOCUMENTS 2,452,988 11/1948 Brown ..... 51/216 R 3,087,281 4/1963 Greening et al. ..... 51/290

3,289,356 12/1966 Hunt et al. ..... 51/227 R

FOREIGN PATENT DOCUMENTS 2903622 8/1980 Fed. Rep. of Germany .

*Primary Examiner*—Frederick R. Schmidt

*Assistant Examiner*—Judy J. Hartman

*Attorney, Agent, or Firm*—Becker & Becker Inc.

[57] ABSTRACT

An apparatus for holding of workpieces, such as gears and the like, the bore of which is to be machined by a tool, especially a honing tool. At least one workpiece is held on a workpiece carrier which is mounted in a floating manner transverse to the tool axis on a base plate. The workpiece carrier is secured against rotation by an arresting device. The arresting device cooperates with a force-absorbing part or disc which is arranged so as to be movable relative to the base plate and the workpiece carrier, and so as to be non-rotatable relative to the base plate by means of a holder in such a manner that the force acting on the arresting device from the workpiece carrier is absorbed by the holder.

20 Claims, 2 Drawing Figures

APPARATUS FOR HOLDING WORKPIECES

The present invention relates to an apparatus for holding workpieces, such as gears or the like, the bore of which is to be machined by a tool, especially a honing tool; at least one workpiece is held on a workpiece support or carrier, which is floatingly mounted on a base plate transverse to the axis of the tool; the workpiece carrier is secured against rotation by an arresting device.

BACKGROUND OF THE INVENTION

Description of the Prior Art

German Offenlegungsschrift No. 29 03 622 discloses a known apparatus according to which the workpieces, during honing, are floatingly mounted by the workpiece-receiving plate transverse to the axis of the tool. The workpiece-receiving plate is provided with an arm which acts as a lever for absorbing or taking up the torque exerted by the honing tool; the arm projects with little play between two stop or abutment rollers which are rotatably mounted in bearing blocks arranged rigidly on the base plate of the apparatus.

However, even with this absorption of the torque, an absolutely free floating movement of the workpieces cannot be attained because the floating movement of the workpieces is hindered by the arresting device. The torque exerted by the honing tool onto the workpieces can be represented as a pair of or noncolinear forces consisting of two forces of equal magnitude. In the equilibrium state, a pair of forces of equal magnitude is directed counter to this pair of forces, whereby the workpieces which are to be machined are forced out of their correct position. Consequently, the workpieces assume an inclined position, which leads to errors in the cylindrical shape of the workpiece bore.

It is an object of the present invention to construct an apparatus of the aforementioned general type in such a way that the torques encountered can be absorbed or taken-up without any influence upon the free-floating movement of the workpieces.

This object, and other objects and advantages of the present invention, will appear more clearly from the following specification in connection with the accompanying drawing.

SUMMARY OF THE INVENTION

Figure 1:
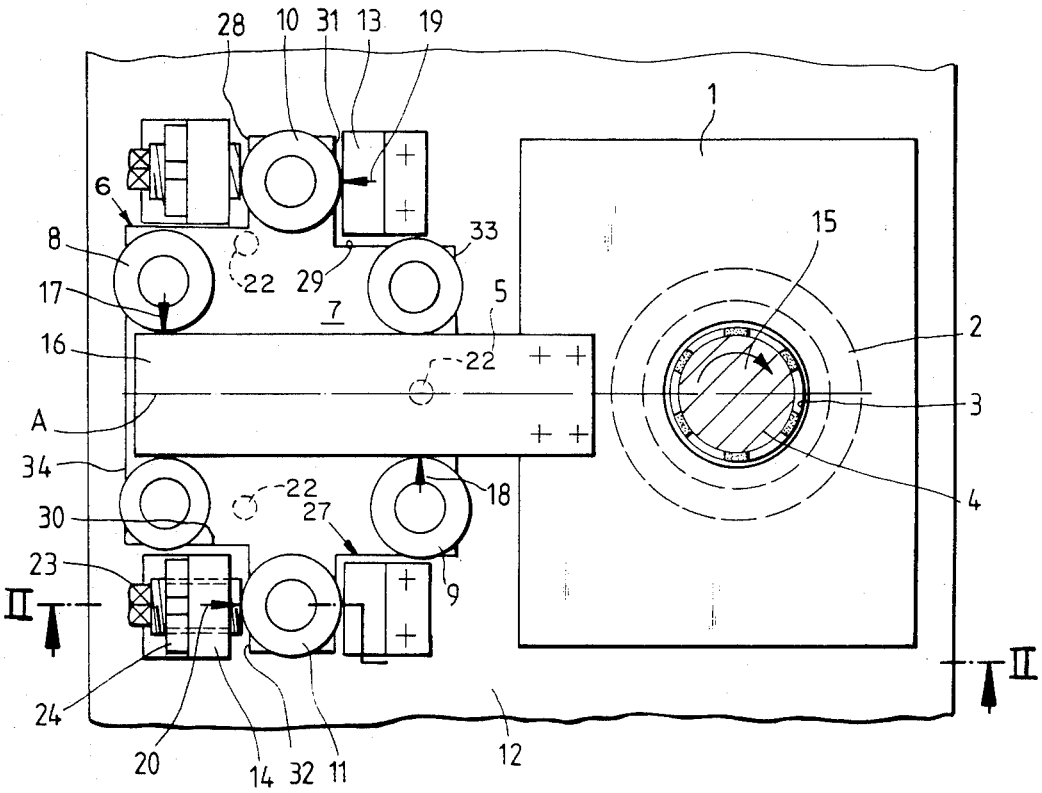
FIG. 1 is a schematic plan view of one embodiment of the apparatus in accordance with the present invention.

The apparatus of the present invention is characterized primarily in that the arresting device cooperates with a force-absorbing part which is arranged so as to be movable relative to the base plate and the workpiece carrier, and so as to be non-rotatable relative to the base plate by means of holding means in such a manner that the force acting from the workpiece carrier on the arresting device is absorbed by the holding means.

As a consequence of this construction, the torque acting on the workpiece carrier is transmitted via the arresting device to the force-absorbing part, which thereby experiences a torque. This torque, however, is absorbed by the holding means, which generates an equally large and opposite counter force. As a result, the force-absorbing part and the workpiece carrier are held in a non-rotatable position, so that the workpiece which is to be machined can no longer be forced out into an inclined position.

DESCRIPTION OF THE PREFERRED EMBODIMENTS

According to specific features of the present invention, the force-absorbing part may be located at least partially in a region externally of the workpiece carrier.

The arresting device may have a first and second stop or abutment piece, such as abutment rollers, and the workpiece carrier may be a plate which has an abutment part, such as an arm, which projects at least partially between the stop or abutment pieces; the abutment or stop pieces may be arranged in such a manner that the second stop or abutment piece forms a counter force for the reaction force generated from the first abutment piece during abutment of the arm, with such reaction force being directed opposite to the counter force and being equally great.

The abutment pieces may be located on different sides of the arm, and in the radial direction to the workpiece axis, may be spaced as far apart as possible on the force-absorbing part. The second abutment piece may be arranged as close as possible to the workpiece carrier, with this spacing being less than the distance between the abutment pieces.

Each abutment piece of the arresting device may be associated with at least one abutment piece of the holding means which is secured on the force-absorbing part. The abutment pieces of the holding means may respectively be located on different sides of and at a distance, preferably with the same distance, from the arm.

The abutment pieces of the holding means may be in alignment transverse to, preferably at right angles to, the axis of the arm.

A counter abutment may respectively be associated with at least one abutment piece of the holding means. Both abutment pieces may rest against an associated counter abutment in a direction parallel to each other. At least one of the counter abutments may be adjustable. The counter abutments may be fastened on the base plate. One of the counter abutments may have an adjusting screw and a lock nut.

The abutment pieces of the holding means may rest against the counter abutments at right angles to the abutment pieces of the arresting device.

All abutment pieces may be constructed alike, preferably as rollers.

A third and fourth pair of abutment pieces may be provided and located in a mirror image with respect to the abutment pieces of the arresting device and of the holding means in such a manner that they absorb equal, oppositely directed forces from those absorbed by the last-mentioned abutment pieces.

The force-absorbing part may be an approximately rectangular disc which is beveled and/or has shoulders in the region of its corners. The diametrically oppositely located corners of the disc may be constructed having mirror symmetry.

DETAILED DESCRIPTION

Figure 2:
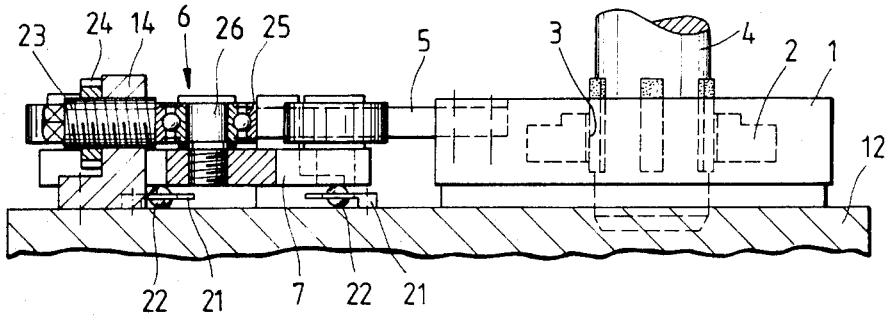
FIG. 2 is a section taken along line II—II in FIG. 1.

Referring now to the drawing in detail, the apparatus according to FIGS. 1 and 2 has an approximately rectangular, plate-like workpiece carrier or support 1 which is mounted in a floating manner and which receives a workpiece, for instance a gear 2, having a bore 3 which can be machined by a honing tool 4.

As shown and described in detail in German Offenlegungsschrift No. 29 03 622, the workpiece-receiving plate or carrier 1 (FIG. 1) is essentially guided in such a way as to be axially immovable between non-illustrated mounting blocks located in pairs and symmetrically relative to the bore 3; however, in a transverse plane, the plate or carrier 1 is freely movable within predetermined limits. The limits are fixed by the play which two oppositely located projections of the workpiece-receiving plate or carrier 1 have within a groove-shaped recess of a spacer.

So that the energy consumption for the transverse movement of the workpiece 2 is as small as possible, the support between the workpiece-receiving plate or carrier 1 and the mounting blocks is constructed in such a way that a hydrostatic film forms between the contact surfaces, and only a liquid or fluid friction arises, which has a low coefficient of friction. For this purpose, the supports are provided with non-illustrated bores through which pressurized oil can be supplied. One of these bores extends parallel to the spindle axis, and proceeds from a transverse bore which extends through the associated mounting blocks and workpiece-receiving plate, and terminates at the base plate 12. The transverse bore is connected with a source of pressurized oil.

The tops of the workpiece-receiving plate or carrier 1 and the mounting blocks have annular grooves which extend concentrically with respect to the transverse bore, as a result of which at the top and bottom of each workpiece-receiving plate there are defined four circular or annular bearing surfaces.

Further axially extending bores, which open into a transverse bore in the base plate 12 and proceed from the annular grooves, are provided for the oil discharge.

The transverse bore is connected by a conduit with an oil tank.

A connecting arm 5 which works as a lever is fastened on the workpiece-receiving plate or carrier 1 to protect against rotation. This connecting arm 5 cooperates with an arresting or stop device 6 located externally of the workpiece-receiving plate 1 and constructed in accordance with the present invention. As a result of this positioning, the inventive apparatus has a low overall height.

The arresting device 6 essentially comprises: a disc-like force-absorbing or receiving part 7 which is mounted on the base plate 12 of the apparatus in such a way as to be transversely movable; the arm 5; and a first arresting or stop pair having first and second stop pieces or rollers 8 and 9 respectively, which are fastened on the force-receiving part or disc 7. The disc 7 lies between the base plate 12 and the arm 5, and consequently in the flux of force which occurs as a consequence of the torque acting on the plate 1 during honing and acting from the plate 1 via the disc 7 onto the base plate 12. The stop or arresting device 6 is provided with a holding means including stop pieces 10, 13 and 11, 14 for securing the disc 7 against rotation. This holding means comprises a second pair of stops or abutments having stop pieces 10 and 11, and two counter stops or abutments 13 and 14 arranged securely on the base plate 12 and constructed as blocks. The stop or abutment pieces 8 through 11 are each formed by identical rollers. The arm 5 is shiftably guided in the radial direction with respect to the workpiece axis between the first pair of stops, rollers or abutments 8, 9. The rollers 8 and 9 are arranged in such a way that the outer end 16 of the arm 5, which end is remote from the workpiece-receiving plate 1, rests against the front roller 8, as determined by the machining direction (arrow 15), during machining of the workpiece 2. The reaction force resulting herefrom, which with the previously known disclosure of German Offenlegungsschrift No. 29 03 622 can lead to a displacement and inclined positioning of the workpiece-receiving plate, is now absorbed by the second roller 9 of this inventive pair of stops. The roller 9 is spaced further from the roller 8 than from the workpiece-receiving plate 1, and rests on that side of the arm 5 remote from the roller 8. As a result, the torque acting on the arm 5 during the machining is always absorbed by the rollers 8 and 9 via a pair of forces represented by the arrows 17, 18, and is thus transferred to the disc-like force-absorbing part 7. The spacing of the roller 9 from the workpiece-receiving plate 1 is small, while the spacing of the rollers 8 and 9 from each other is as large as possible, and preferably equals the spacing of the rollers 10 and 11 from each other. Consequently, large leverages and correspondingly small abutment or stop forces are assured.

The disc-like force-absorbing part 7, which is movably mounted on the base plate 12 by three roller balls or bearings 22 held in cages 21, rests via the second pair of stops or abutments 10, 11 against the abutment or stop supports 13 and 14 which are rigidly connected with the base plate 12, as represented by the force arrows 19, 20. The rollers are thus arranged in such a way that the arresting directions between the first and the second pairs of stops or abutments 8, 9 and 10, 11 are displaced relative to each other by a right angle. The disc-like force-absorbing part 7 is consequently mounted in such a way as to be movable transverse to the shifting or displacement direction of the arm 5, so that a floating movement of the workpiece-receiving plate 1 which is free of forces in all directions is assured.

That abutment piece 10 of the holding means, as seen in a direction from the first abutment piece 8 toward the workpiece carrier 1 in the axial direction A of the arm 5, which is associated with the first abutment piece 8 lies before or ahead of the abutment piece 8; and that abutment piece 11 of the holding means associated with the second abutment piece 9 is behind or lies after the latter or second abutment piece 9.

The rollers or stop pieces 8, 9, 10, 11 are preferably formed by commercially available roller bearings 25 which are rotatably mounted on pins 26 which are rigidly installed in the disc-like force-absorbing part 7 (FIG. 2).

To adjust the lever guidance between the two rollers 8, 9 in a manner free of play, one of the two stop or abutment supports 13, 14, for example the stop support 14, may be made adjustable by means of an adjusting screw or setscrew 23, and a lock nut 24.

In a variation of the previously described embodiment there may be, especially advantageous to stack several workpiece-receiving plates one above the other in a known manner, and to machine the workpieces simultaneously with a common honing tool, whereby each workpiece-receiving plate has a separate arresting device 6 and holding means associated therewith.

Furthermore, in addition to the embodiment according to FIGS. 1 and 2 for machining in a clockwise direction, as represented by arrow 15, a machining is also possible in the counterclockwise direction by an appropriate mirror-image embodiment of the described arrangement as indicated according to FIG. 1. The machining can also be undertaken with alternating turning direction, which is very advantageous for certain applications, if, according to a further feature of the present invention, two additional pairs of rollers as indicated according to FIG. 1 are provided which are arranged in a mirror-image to the illustrated stop or abutment pairs 8, 9 and 10, 11, and which absorb oppositely directed noncolinear forces.

Finally, in place of the structural elements set forth, other structural elements can also be employed; for instance, the rollers 8, 9, 10, 11 can be replaced by suitably constructed sliding contact members.

To save weight and space, the disc-like force-absorbing part 7 is constructed in a shoulder-like or beveled manner in the region of its corners. The beveled corners 27, 28, and the shoulders 29 and 30, are respectively located diagonally with respect to the remaining, approximately rectangular plate. The stop supports 13 and 14 are arranged in the region of the shoulders 29 and 30, whereby each support 13 and 14 extends approximately over the entire length of a shoulder surface 31 or 32 of the disc-like force-absorbing part 7 which extends at right angles to the longitudinal axis A of the arm 5. The other shoulder surfaces 33 and 34 respectively extend approximately at an angle of 45° with respect to this longitudinal axis A. The end faces of the corners 27 and 28 have a corresponding though opposite incline; these end faces of the corners 27 and 28, and the surfaces 33 and 34, extend essentially over the entire distance between the rollers 8 and 10 or 9 and 10, and the roller 10 and the arm 5, or the roller 11 and the arm 5. The diametrically oppositely located corners 27, 28, 29, 30 are constructed so as to have mirror symmetry.

The present invention is, of course, in no way restricted to the specific disclosure of the specification and drawing, but also encompasses any modifications with the scope of the appended claims.

What I claim is:

1. An apparatus for holding workpieces having a bore which is to be machined by a tool, said apparatus comprising:

a base plate;

a workpiece carrier mounted on said base plate and including means for support thereof in a floating manner freely movable transverse to the axis of said tool, with at least one workpiece being held on said workpiece carrier; and an arresting device including means for connection thereof relative to said base plate for securing said workpiece carrier against rotation;

a force-absorbing part included with said arresting device, said force-absorbing part being movable relative to said base plate and said workpiece carrier; and holding means for keeping said force-absorbing part non-rotatable relative to said base plate, said holding means also including abutment means absorbing force acting on said arresting device from said workpiece carrier while machining forces are transferred relative to said base plate said abutment means comprising a first abutment piece and a second abutment piece, said workpiece carrier being a plate having an abutment part in the form of an arm which projects at least partially between said first and second abutment pieces; said first and second abutment pieces being arranged in such a way that said second abutment piece forms a counter force for a reaction force generated from said first abutment piece during abutment of said arm there against with said reaction force being equal and opposite to said counter force.

2. An apparatus according to claim 1, in which said force-absorbing part is located at least partially externally of said workpiece carrier.

3. An apparatus according to claim 1, in which said first and second abutment pieces are located on said force-absorbing part, on different sides of said arm, and spaced apart in the direction radial to the axis of said workpiece.

4. An apparatus according to claim 3, in which said second abutment piece is arranged close to said workpiece carrier, with this distance being less than the distance between said first and second abutment pieces.

5. An apparatus according to claim 4, in which said holding means includes at least a third abutment piece and a fourth abutment piece, which are secured on said force-absorbing part, with said first abutment piece being cooperative at least with said third abutment piece, and with said second abutment piece being cooperating at least with said fourth abutment piece.

6. An apparatus according to claim 5, in which said third and fourth abutment pieces are respectively located on opposite sides of, and at a distance from, said arm.

7. An apparatus according to claim 6, in which said third and fourth abutment pieces are located at the same distance from said arm.

8. An apparatus according to claim 5, in which, when viewed in a direction from said first abutment piece toward said workpiece carrier in the axial direction of said arm, said third abutment piece is ahead of said first abutment piece, and said fourth abutment piece is behind said second abutment piece.

9. An apparatus according to claim 8, in which said third and fourth abutment pieces are in alignment transverse to the axis of said arm.

10. An apparatus according to claim 9, in which said holding means further includes at least one counter abutment for cooperating with one of said third and fourth abutment pieces.

11. An apparatus according to claim 10, which includes two counter abutments, said third and fourth abutment pieces resting against a counter abutment in a direction parallel to each other.

12. An apparatus according to claim 11, in which at least one of said counter abutments is adjustable.

13. An apparatus according to claim 12, in which that counter abutment cooperative with said fourth abutment piece is provided with an adjusting screw and a lock nut.

14. An apparatus according to claim 11, in which said counter abutments are fastened on said base plate.

15. An apparatus according to claim 14, in which said third and fourth abutment pieces rest against said counter abutments at right angles to the direction in which said first and second abutment pieces rest against said arm.

16. An apparatus according to claim 15, in which all of said abutment pieces are constructed the same.

17. An apparatus according to claim 16, in which all of said abutment pieces are rollers.

18. An apparatus according to claim 15, which includes two more pairs of abutment pieces which are located mirror image with respect to said first, second, third, and fourth abutment pieces in such a way that they absorb equal and opposite forces from those absorbed by said first, second, third, and fourth abutment pieces.

19. An apparatus according to claim 15, in which said force-absorbing part is an approximately rectangular plate, the corner regions of which are angled-off.

20. An apparatus according to claim 19, in which the respectively diametrically opposite corners of said force-absorbing part have mirror symmetry.

* * * * *